US007639212B2

(12) United States Patent
Otsuka et al.

(10) Patent No.: US 7,639,212 B2
(45) Date of Patent: Dec. 29, 2009

(54) AC-TYPE GAS-DISCHARGE DISPLAY DEVICE

(75) Inventors: Akira Otsuka, Miyazaki (JP); Takashi Sasaki, Miyazaki (JP); Akhiro Takagi, Miyazaki (JP)

(73) Assignee: Fujitsu Hitachi Plasma Display Limited, Higashimorokata (JP)

( * ) Notice: Subject to any disclaimer, the term of this patent is extended or adjusted under 35 U.S.C. 154(b) by 596 days.

(21) Appl. No.: 11/596,067

(22) PCT Filed: Aug. 17, 2005

(86) PCT No.: PCT/JP2005/015020

§ 371 (c)(1),
(2), (4) Date: Nov. 9, 2006

(87) PCT Pub. No.: WO2006/019119

PCT Pub. Date: Feb. 23, 2006

(65) Prior Publication Data

US 2008/0136748 A1 Jun. 12, 2008

(30) Foreign Application Priority Data

Aug. 18, 2004 (JP) ..... 2004-238245

(51) Int. Cl.
*G09G 3/28* (2006.01)

(52) U.S. Cl. ..... 345/60; 345/67

(58) Field of Classification Search ..... 346/37, 346/60–68; 315/169.4

See application file for complete search history.

(56) References Cited

U.S. PATENT DOCUMENTS

2003/0174101 A1* 9/2003 Kawasaki et al. ..... 345/60
2006/0001600 A1* 1/2006 Ito ..... 345/60

FOREIGN PATENT DOCUMENTS

JP 06-004039 1/1994

(Continued)

OTHER PUBLICATIONS

International Search Report dated Nov. 22, 2005 of International application PCT/JP/2005/015020.

*Primary Examiner*—Richard Hjerpe
*Assistant Examiner*—Mansour M Said
(74) *Attorney, Agent, or Firm*—Staas & Halsey

(57) ABSTRACT

A novel PDP device capable of reducing the peak current of a sustain discharge without the need to modify circuits has been disclosed. The PDP device is an AC-type gas-discharge display device comprising an AC-type gas-discharge panel 1 having a plurality of first electrodes X and a plurality of second electrodes Y arranged by turns substantially in parallel and a plurality of third electrodes A arranges so as to intersect the first and second electrodes, and in which a cell is formed at the intersection of a combination of the first and second electrode and the third electrode, wherein a cell to be lit is selected during an address period and a discharge is caused to occur for the display in the selected cell by applying sustain pulses of opposite polarities alternately between the first and second electrodes during a sustain discharge period, the plurality of the third electrodes are divided into a first group and a second group, and a fixed voltage 0 V is applied to the third electrode of the first group and the third electrode of the second group is brought into a high impedance state during the sustain discharge period.

11 Claims, 7 Drawing Sheets

FOREIGN PATENT DOCUMENTS

| | | |
|---|---|---|
| JP | 7-248744 | 9/1995 |
| JP | 9-68946 | 3/1997 |
| JP | 10-133622 | 5/1998 |
| JP | 10-187090 | 7/1998 |
| JP | 10-187093 | 7/1998 |
| JP | 11-149274 | 6/1999 |
| JP | 11-184428 | 7/1999 |
| JP | 2002-140031 | 5/2002 |
| JP | 2003-271089 | 9/2003 |
| JP | 2005-308893 | 11/2005 |
| WO | 98/21706 | 5/1998 |

* cited by examiner

AC-TYPE GAS-DISCHARGE DISPLAY DEVICE

CROSS REFERENCE TO RELATED APPLICATIONS

This application is a continuing application, filed under 35 U.S.C. §111(a), of International Application PCT/JP2005/015020, filed Aug. 17, 2005, it being further noted that priority is based upon Japanese Patent Application 2004-238245, filed Aug. 18, 2004, the content of which are incorporated herein.

TECHNICAL FIELD

The present invention relates to an AC-type gas-discharge display device, such as a display device for a personal computer or work station, a flat television, and one used to display advertisement and information, for example, a plasma display device (PDP device).

BACKGROUND TECHNIQUE

An AC-type gas-discharge display device is a large-sized/large capacity flat display and is also used as a household wall-mounted television. AC-type gas-discharge display devices include a two-electrode type and a three-electrode type, various systems such as an address/display non-separation system in which a period during which a cell to be displayed is defined (address period) and a display period (sustain period) during which a discharge is caused to occur to display and light the cell are shifted sequentially, and an address/display separation system in which those periods are separated. The present invention is applied to a three-electrode type AC-type gas-discharge display device, PDP device, of the address/display separation system as an example of the PDP devices.

In a three-electrode AC-type plasma display panel, a front glass substrate, which is a display screen, and a back glass substrate are arranged in opposition to each other with a discharge space sandwiched in between, a plurality of first (X) electrodes and a plurality of second (Y) electrodes are arranged by turns so as to make pairs on the front glass substrate, and the surface is covered with a dielectric layer. On the back glass substrate, a plurality of third (address) electrodes are provided so as to intersect the X and Y electrodes at right angles and a noble gas is sealed in the discharge space. On the address electrode, a phosphor layer, that emits light due to ultraviolet radiation generated by a discharge, is provided. A cell is formed at the intersection of a combination of the X electrode and the Y electrode that makes a pair and the address electrode. Ribs are provided between the address electrodes and the cells are separated into columns.

A PDP device is constituted by a plasma display panel, drive circuits for driving various electrodes provided on the plasma display panel, a control circuit for controlling the drive circuits, etc. A plasma display panel is capable of only providing lit or unlit states and therefore a gradated display cannot be provided. Because of this, a PDP device provides a gradated display by constituting one display frame by a plurality of subframes and combining the subframes to be lit. Each subframe is constituted by a reset period during which all cells are brought into a uniform state, an address period during which cells (display cells) to be displayed (lit) are selected, and a sustain discharge period during which the selected display cells are lit. In a general drive method, during the reset period, a high voltage is applied between all the X electrodes and Y electrodes and between all the address electrodes and the Y electrodes to cause a reset discharge to occur on the entire surface of the panel, whereby all the cells are brought into a uniform state. During the address period, a scan pulse is applied sequentially to the Y electrode and, in synchronization with the application of the scan pulse, an address pulse is applied to the address electrode of the display cell to cause an address discharge to occur in the display cell. Wall charges are formed in the cell in which the address discharge has occurred. During the sustain discharge period, a sustain pulse is applied alternately between all the X electrodes and the Y electrodes. Due to this, sustain discharge voltages of opposite polarities are applied alternately between the X electrodes and the Y electrodes and in the display cell, the voltage due to the wall charges formed by the address discharge is added and a sustain discharge is caused to occur, however, in the non-display cell, wall charges are not formed and therefore a discharge is not caused to occur by the sustain discharge voltage. The number of times of the sustain pulse is set for each subframe and the luminance of the subframe is determined by the number of times of the sustain discharge.

The conventional PDP device is explained as above. However, the PDP device is described in patent documents 1 to 3 etc. and, therefore, a more detailed explanation is omitted here.

A PDP device is required to have a display quality and a cost at the same level as those of a CRT. As mentioned above, during the sustain discharge period, the sustain pulse is applied repeatedly between all the X electrodes and the Y electrodes and the sustain discharge is caused to occur on the entire surface and therefore, the peak current of the sustain discharge becomes very large. In particular, the larger the current is, the more the luminance/light emission can be improved. Because of this, it is necessary for the drive circuit that supplies the X electrode and the Y electrode with the sustain pulse to be capable of supplying such a large current at high speed and, therefore, there arises a problem that the cost is increased. Further, if a large current flows, the voltage drop due to the resistance of the electrode and the wire becomes large and the voltage to be supplied differs depending on the position of the cell and, therefore, there arises a problem that the luminance is reduced partially and the operating margin is reduced. In particular, the reduction in luminance produces unevenness an streaking and degrades the display quality because of luminance changes between a row (display) line with many display cells and a row line with few display cells.

Consequently, it has been suggested to reduce the peak current of the sustain discharge. It is known that if the frequency of the sustain discharge is increased, the luminance can be increased and, in accordance with this, the discharge current can be reduced. However, if the drive frequency of the drive circuit is increased, the power loss is increased and there arises a problem that the cost of the circuit is raised and further, there arises another problem of the limit of the operation frequency for stably performing the operation of the sustain discharge. Because of this, at present, it is difficult to further increase the frequency of the sustain discharge.

On the contrary, it has been suggested to reduce the peak current by lengthening the intervals of the sustain discharges, that is, by making the rise of the sustain discharge more gradual, however, this method will reduce the number of times of the sustain discharge during the sustain discharge period and degrade the luminance and therefore, the method cannot be used.

Patent document 1 describes a configuration, in which the pairs of the X electrode and the Y electrode are divided into a plurality of groups and, by shifting the application timing of the sustain pulse to cause the sustain discharge to occur at different timings, the peak current of the sustain discharge is reduced. However, with the configuration described in patent document 1, there is a problem that, as one period of the sustain discharge is increased substantially, it is difficult to realize a high-frequency drive and a high luminance for the above-mentioned reason. Further, with the configuration described in patent document 1, a pair of the X and Y electrodes charges and discharge the inter-electrode capacitance between the pair and the Y electrode of a neighboring pair and between the pair and the X electrode of the other neighboring pair and, therefore, there arises a problem that power consumption is increased.

In patent document 2, a configuration is described in which the address electrodes are divided into two groups, and to the address electrodes of one of the groups, a discharge promotion pulse, which is synchronized with the sustain pulse and which is earlier and narrower than the rise of the sustain pulse, is applied, and to the address electrodes of the other group, a fixed voltage is applied, whereby a trigger discharge is caused to occur in the display cell of the address electrode of the one of the groups. Due to this, in the display cell of the address electrode of the one of the groups, the sustain discharge is caused to occur earlier than the sustain discharge in the display cell of the address electrode of the other group and, thereby, the peak current of the sustain discharge is reduced.

However, with the configuration described in patent document 2, it cannot be said that the wall charges are utilized sufficiently when the discharge promotion pulse is applied to the address electrode to cause a discharge to occur and therefore, it is necessary to raise the voltage of the discharge promotion pulse in order to obtain a sufficient effect of the trigger discharge and there arises a problem that power consumption is increased. Further, there is a problem that the power consumption is large because both the rise and the fall of the discharge promotion pulse are shifted from the rise and fall timing of the sustain pulse.

Patent document 3 describes a configuration in which the pulse is applied alternately to odd-numbered address electrodes and even-numbered address electrodes in synchronization with the sustain pulse, whereby the occurrence of the sustain discharge is shifted and thus the peak current is reduced.

However, with the configuration described in patent document 3, the pulse is applied to the odd-numbered address electrodes and the even-numbered address electrodes separately and therefore, there is a problem that power consumption is large. Further, the pulse applied to the address electrode is synchronized with the sustain pulse and, therefore, there is a problem that the dispersing effect of the discharge timing is insufficient.

Patent document 1: Japanese Unexamined Patent Publication (Kokai) No. 6-4039

Patent document 2: Japanese Unexamined Patent Publication (Kokai) No. 11-149274

Patent document 3: Japanese Unexamined Patent Publication (Kokai) No. 10-133622

DISCLOSURE OF THE INVENTION

Problem to be Solved by the Invention

As described above, what is essential is to reduce the peak current of the sustain discharge and there are various measures therefor, however, none of them is sufficiently effective.

An object of the present invention is to realize a novel configuration capable of reducing the peak current of the sustain discharge without modifying the currently existing circuit.

Means for Solving Problem

In order to realize the above-mentioned object, in a plasma display device according to a first aspect of the present invention, third (address) electrodes are divided into first and second groups and during a sustain discharge period, a fixed voltage is applied to the third electrode of the first group and the third electrode of the second group is caused to have a high impedance.

In other words, the plasma display device according to the first aspect of the present invention is characterized by being an AC-type gas-discharge display device, comprising an AC-type gas-discharge panel having a plurality of first and second electrodes extending in a first direction and arranged by turns substantially in parallel and a plurality of third electrodes extending in a direction perpendicular to the first direction and arranged so as to intersect the first and second electrodes and in which a cell is formed at the intersection of a combination of the first and second electrodes and the third electrode, wherein: during an address period, an address discharge is caused to occur between the second electrode and the third electrode to select a cell to be lit; during a sustain discharge period, sustain pulses of opposite polarities are applied alternately between the plurality of the first electrodes and the plurality of the second electrodes to cause a discharge to occur for the display of the cell selected during the address period; the plurality of the third electrodes are divided into first and second groups; and during the sustain discharge period, a fixed voltage is applied to the third electrode of one of the first and second groups and the third electrode of the other of the first and second groups is caused to have a high impedance.

According to the first aspect of the present invention, during the sustain discharge period, the other third electrode of the other of the first and second groups has a high impedance and, therefore, its potential is between the potential of the first (X) electrode and the second (Y) electrode. On the other hand, to the third electrode of the one of the first and second groups, a fixed voltage, such as 0 V, is applied and therefore, the timing of occurrence of the sustain discharge differs between the cell formed by the third electrode of the one of the first and second groups and the cell formed by the third electrode of the other of the first and second groups. Due to this, the sustain discharge is dispersed and the peak current can be reduced. In the first aspect, what is arranged is only that a fixed voltage is applied to the third electrode of the one group similarly as before and the third electrode of the other group is caused to have a high impedance and therefore, the increase in power consumption is very small.

Further, in general, the driver IC constituting the third electrode drive circuit for driving the third electrode has a function of causing the output to have a high impedance for each IC or output, in addition to the function of outputting a predetermined power and, if the function is utilized, it is possible to realize the PDP device according to the first aspect of the present invention without modifying the conventional circuit.

Further, the number of outputs of the driver IC is less than a number of the third electrodes and therefore, in general, the third electrodes are driven by a plurality of the driver ICs. When the driver IC has the function of causing the output to have a high impedance for each IC, division is made into groups so that the third electrodes connected to the same driver IC belong to the same group. When the driver IC has the function of causing the output to have a high impedance for each output, division of the third electrodes into groups can be made arbitrarily.

In the cell the discharge timing of which is different, luminance etc. differs more or less and therefore, it is desirable to change the state of the third electrode of the group for each subframe and/or frame. In other words, the design is done so that the state in which a fixed voltage is applied to the third electrode of the one of the groups and the third electrode of the other group has a high impedance is changed to the other state in which the third electrode of the one of the groups has a high impedance and a predetermined voltage is applied to the third electrode of the other group, and the states are switched for each subframe and/or frame. Further, it is also possible for the states to switch for each sustain pulse and the states may switch for each sustain pulse or for each group of several sustain pulses.

In order to realize the above-mentioned object, in a plasma display device according to a second aspect of the present invention, a plurality of third (address) electrodes are divided into first and second groups and during the sustain discharge period, a first preceding sustain pulse, which rises before the rise of the sustain pulse to be applied to a first (X) electrode and falls substantially in synchronization with the fall of the sustain pulse to be applied to the first electrode, is applied to the third electrode of one of the first and second groups, and a second preceding sustain pulse, which rises before the rise of the sustain pulse to be applied to a second (Y) electrode and falls substantially in synchronization with the fall of the sustain pulse to be applied to the second electrode, is applied to the third electrode of the other of the first and second groups.

In other words, the plasma display device according to the second aspect of the present invention is characterized by being an AC-type gas-discharge display device, comprising an AC-type gas-discharge panel having a plurality of first and second electrodes extending in a first direction and arranged by turns substantially in parallel and a plurality of third electrodes extending in a direction perpendicular to the first direction and arranged so as to intersect the first and second electrodes and in which a cell is formed at the intersection of a combination of the first and second electrodes and the third electrode, wherein: during an address period, an address discharge is caused to occur between the second electrode and the third electrode to select a cell to be lit; during a sustain discharge period, sustain pulses of opposite polarities are applied alternately between the plurality of the first electrodes and the plurality of the second electrodes to cause a discharge to occur for the display of the cell selected during the address period; the plurality of the third electrodes are divided into first and second groups; and during the sustain discharge period, a first preceding sustain pulse, which rises before the rise of the sustain pulse to be applied to the first electrode and falls substantially in synchronization with the fall of the sustain pulse to be applied to the first electrode, is applied to the third electrode of one of the first and second groups and a second preceding sustain pulse, which rises before the rise of the sustain pulse to be applied to the second electrode and falls substantially in synchronization with the fall of the sustain pulse to be applied to the second electrode, is applied to the third electrode of the other of the first and second groups.

According to the second aspect of the present invention, in the cell formed by the third electrode of the one of the first and second groups, when the sustain pulse is applied to the second electrode and the sustain discharge is caused to occur, no pulse is applied and the potential is a predetermined potential and therefore, when the sustain discharge due to the sustain pulse applied to the second electrode terminates, positive charges are accumulated on the third electrode. At this time, positive charges are accumulated on the first electrode and negative charges are accumulated on the second electrode. Next, if the preceding sustain pulse is applied to the third electrode before the sustain pulse is applied to the first electrode, the voltage due to the positive charges accumulated on the third electrode is added and a slight trigger discharge is caused to occur between the third electrode and the second electrode. If the sustain pulse is applied to the first electrode immediately after that, as the trigger discharge has occurred before, the sustain discharge occurs immediately between the first electrode and the second electrode. At this time, in the cell formed by the third electrode of the other of the first and second groups, the second preceding sustain pulse is not applied to the third electrode, and therefore, no trigger discharge occurs and the sustain discharge between the first electrode and the second electrode occurs delayingly as conventionally. In other words, the sustain discharge in the cell formed by the third electrode of the other group is delayed from the sustain discharge in the cell formed by the third electrode of the one of the groups, and therefore, the sustain discharge is dispersed and the peak current can be reduced.

Similarly, when the second preceding sustain pulse is applied to the third electrode in the cell formed by the third electrode of the other group, the voltage due to the accumulated positive wall charges is added and a slight trigger discharge occurs between the third electrode and the first electrode on which negative charges are accumulated, and the delay of the sustain discharge is slight. At this time, in the cell formed by the third electrode of the one of the groups, the first preceding sustain pulse is not applied and, therefore, the delay of the sustain discharge is significant. Consequently, the sustain discharge is dispersed and the peak current can be reduced.

By the way, if the first and second groups are further divided and the voltages or timings of the first and second preceding sustain pulses are made to differ from each other, the sustain discharge can be further dispersed.

When it is possible for the driver IC to set the output voltage for each IC, as in the first aspect, division is made into groups so that the third electrodes connected to the same driver IC belong to the same group, and when it is possible for the driver IC to set the output voltage independently for each output, the third electrodes can be divided into groups arbitrarily.

Further, as in the first aspect, in the cell the discharge timing of which is different, luminance etc. differs and, therefore, it is desirable to change the state of the third electrode of the group for each subframe and/or frame.

As described above, it is possible to make the delay of the sustain discharge differ from each another by dividing the third (address) electrodes into a plurality of groups and by making the voltage of the third electrode of each group differ from each another during the sustain discharge period, and if the voltage value or the switching timing is changed, the delay of the sustain discharge will change accordingly. However, luminance or the like differs more or less depending on such differences. Then, if the voltage value to be applied to the third electrode or the switching timing is changed in random in each group, the differences in time are averaged on the entire screen and become inconspicuous.

EFFECT OF THE INVENTION

According to the first aspect of the present invention, it is possible to reduce the peak current of the sustain discharge without modifying the currently existing circuit configuration and without increasing power consumption. Due to this, it is possible to reduce the cost by configuring the circuit by devices with less current ratings.

According to the second aspect of the present invention, it is possible to reduce the peak current of the sustain discharge without modifying the currently existing circuit configuration and with a smaller increase in power consumption compared with the conventional example. Due to this, it is possible to reduce the cost by configuring the circuit using devices with lower current ratings.

EXPLANATIONS OF LETTERS AND NUMERALS

Figure 1:
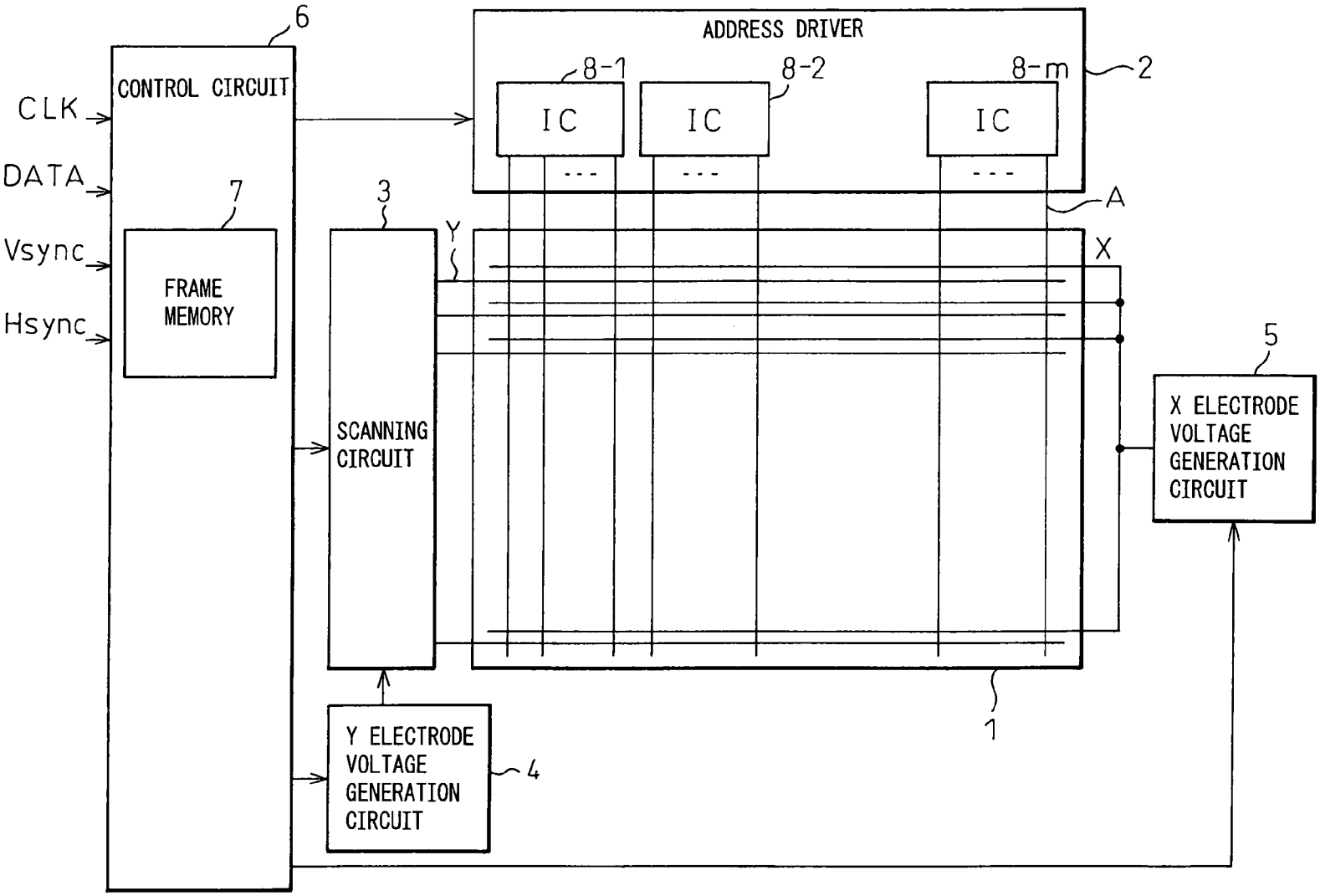
FIG. 1 is a block diagram showing a general configuration of a plasma display (PDP) device in a first embodiment of the present invention.

1 plasma display panel
2 address driver
3 scanning circuit
4 Y electrode voltage generation circuit
5 X electrode voltage generation circuit
6 control circuit
8-1, 8-2, **8-*n*** driver IC

PREFERRED EMBODIMENTS OF THE PRESENT INVENTION

FIG. 1 is a block diagram showing a general configuration of a plasma display (PDP) device in a first embodiment of the present invention. The PDP device is a three-electrode type address/display separation system PDP device.

As shown schematically, the PDP device in the first embodiment has a three-electrode AC-type plasma display panel 1, an address driver 2 for driving address electrodes, a scanning circuit 3 for driving Y electrodes, a Y electrode voltage generation circuit 4 for generating various voltages to be applied to the Y electrode and supplying them to the scanning circuit 3, an X electrode voltage generation circuit 5 for generating various voltages to be applied to the X electrode and applying them commonly to all the X electrodes, and a control circuit 6 for performing the control of each part. Upon receipt of a clock CLK, display data DATA, a vertical synchronization signal Vsync, a horizontal synchronization signal Hsync, etc., supplied from the outside, the control circuit 6 expands the display data temporarily in a frame memory 7 to transform it into data having a subframe configuration for the display by the PDP device and then supplies it to the address driver 2.

As described above, the three-electrode AC type plasma display panel 1 has a plurality of X electrodes and a plurality of Y electrodes arranged by turns so as to make pairs, and a plurality of address electrodes arranged so as to intersect them. A cell is formed at the intersection of a combination of the X electrode and the Y electrode that make a pair and the address electrode. The plurality of the X electrodes are commonly connected at their ends.

The address driver 2 is configured by a plurality of drives IC8-1, 8-2, . . . , **8-*m*. Each drive IC has p outputs and drives p address electrodes. Consequently, it is necessary for m×p to be greater than the number of address electrodes. The drive IC has a shift register internally and outputs a corresponding voltage signal to the output terminal when data of one row is collected by sequentially shifting data supplied from the control circuit 6. It is possible for the drive IC to output a plurality of voltages supplied from the outside as well as causing the output to have a high impedance. The drive IC in the first embodiment causes all of the outputs to have a high impedance simultaneously when causing the output to have a high impedance, however, it is also possible to use one capable of arbitrarily causing each output to have a high impedance. The plurality of the drives IC8-1, 8-2, . . . , 8-*m*** are divided into two groups. Here, division is made so that the odd-numbered drive ICs belong to a first group and the even-numbered drive ICs belong to a second group.

Figure 2:
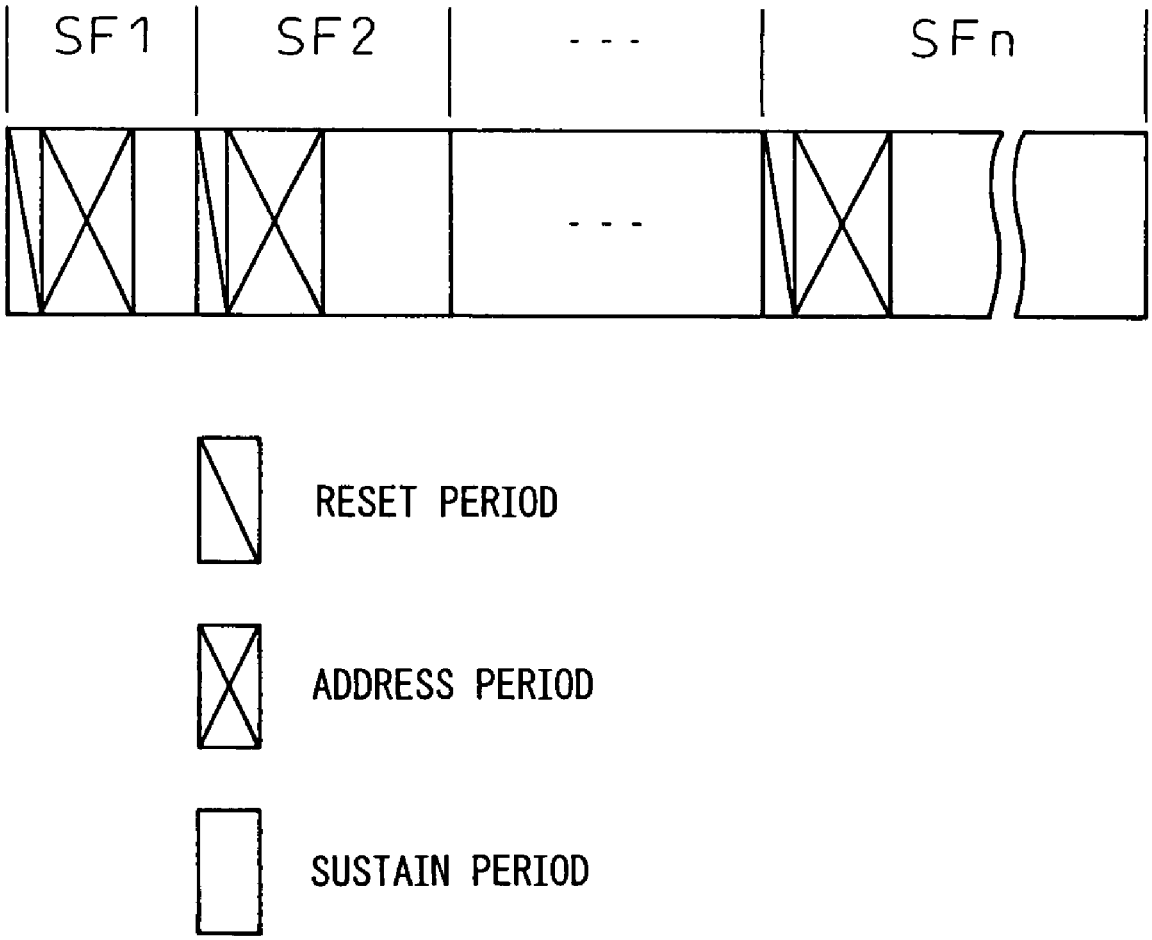
FIG. 2 is a diagram showing a configuration example of a display frame.

FIG. 2 is a diagram showing a configuration of a display frame. As described above, the plasma display panel is capable of only controlling the lit/unlit states and therefore a gradated display cannot be provided. Because of this, as shown in FIG. 2, a gradated display is provided by configuring one display frame by a plurality of subframes SF1, SF2, . . . , SFn and combining subframes to be lit. Each subframe is configured by a reset period during which all cells are brought into a uniform state, an address period during which cells (display cells) to be displayed (lit) are selected, and a sustain discharge period during which the selected display cells are lit. The number of times of the sustain pulse is set for each subframe and the luminance of the subframe is determined by the number of times of the sustain discharge.

Figure 3:
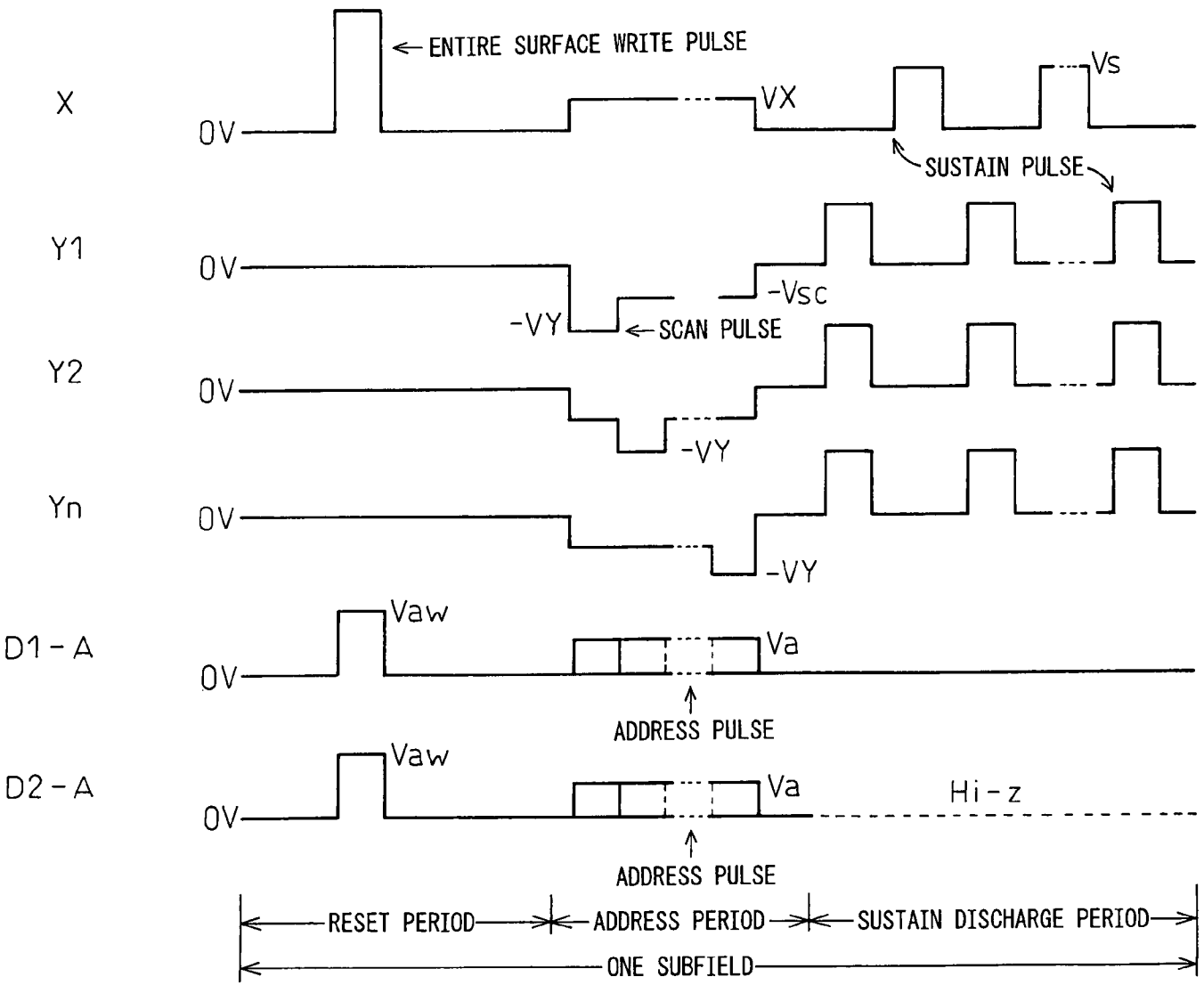
FIG. 3 is a diagram showing drive waveforms of the PDP device in the first embodiment.

FIG. 3 is a diagram showing drive waveforms of each subframe of the PDP device in the present embodiment. X on the left side indicates the waveform to be applied commonly to the X electrode, Y1, Y2, and Yn indicate the waveforms to be applied to the first, second, and n-th Y electrodes, D1-A indicates the waveform to be applied to the address electrodes connected to the drive ICs of the first group (hereinafter, the address electrodes of the first group), and D2-A indicates the waveform to be applied to the address electrode connected to the drive ICs of the second group (hereinafter, the address electrodes of the second group).

As shown schematically, during the reset period, in a state in which 0 V is applied to all the Y electrodes, the entire surface write pulse of high voltage is applied to all the X electrodes and a voltage Vaw is applied to all the address electrodes, thereby the reset discharge is caused to occur on the entire panel surface to bring all the cells into a uniform state. During the address period, in a state in which a voltage VX is applied to all the X electrodes, a voltage −Vsc is applied to the Y electrode and further, the scan pulse of voltage −VY is applied sequentially, and in synchronization with the application of the scan pulse, an address pulse Va is applied to the address electrode in the display cell to cause the address discharge to occur in the display cell. In the display cell in which the address discharge has occurred, wall charges are formed.

During the sustain discharge period, the sustain pulse is applied alternately between all the X electrodes and the Y electrodes. Due to this, the sustain discharge voltages of opposite polarities are applied alternately between the X electrode and the Y electrode and in the display cell, the voltage due to the wall charges formed by the address discharge is added and the sustain discharge occurs, however, in the non-display cell, no wall charges are formed and, therefore, the discharge does not occur only due to the sustain discharge voltage. The number of times of the sustain pulse is set for each subframe and the luminance of the subframe is determined by the number of times of the sustain discharge.

The above configuration is the same as that in the conventional example, however, it differs from the conventional example in that, in the example in FIG. 3, during the sustain discharge period, 0 V is applied to the address electrode of one of the groups (here, the first group) and the address electrode of the other group (here, the second group) is caused to have a high impedance.

Figure 4:
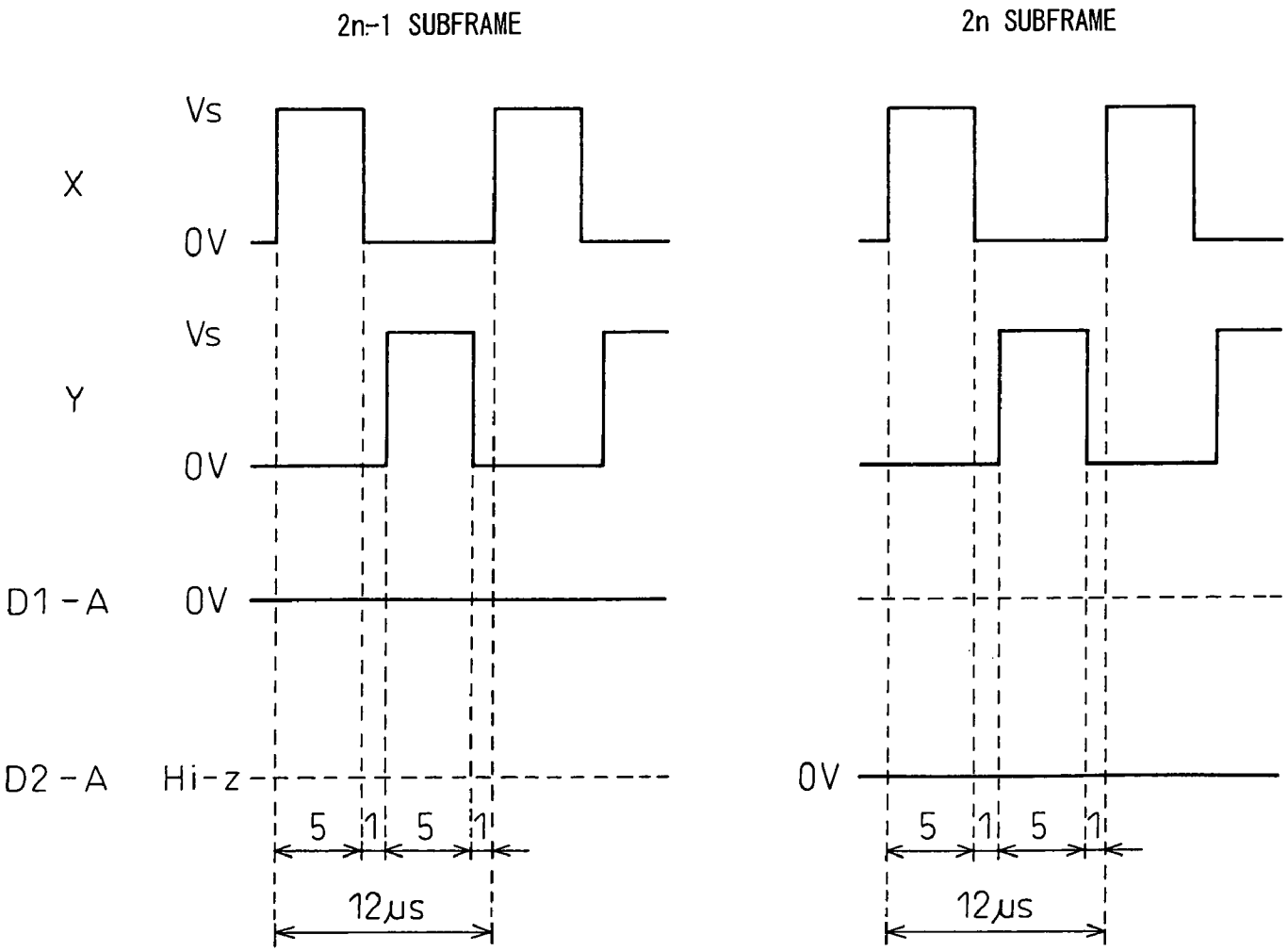
FIG. 4 is a diagram showing the detail of the drive waveforms in the first embodiment.

FIG. 4 is a diagram showing the drive waveforms during the sustain discharge period in the first embodiment; the left side shows the drive waveforms in the odd-numbered (2n−1) subframes in the subframe configuration in FIG. 2 and the right side shows the drive waveforms in the even-numbered (2n) subframes. One period of the sustain pulse is 12 μs and the width of one sustain pulse is 5 μs, and the sustain pulse is applied at intervals of 1 μs. As shown schematically, during the sustain discharge period of the odd-numbered subframe, 0 V is applied to the address electrode of the first group and the address electrode D2-A of the second group is cause to have a high impedance. During the sustain discharge period of the even-numbered subframe, the address electrode D1-A of the first group is caused to have a high impedance and 0 V is applied to the address electrode D2-A of the second group.

On the address electrode to which 0 V is applied, wall charges are accumulated due to the previous sustain discharge and a slight opposing discharge occurs between the address electrode and the X electrode or between the address electrode and the Y electrode at the time of the rise of the sustain pulse. This slight opposing discharge causes the sustain discharge between the X electrode and the Y electrode to rise earlier. In contrast to this, when the address discharge is at a high impedance, the potential of the address electrode approaches the middle potential of the X electrode and the Y electrode due to the line capacitance. Because of this, on the address electrode at a high impedance, there are formed fewer wall charges than on the address electrode clamped to 0 V during the sustain discharge, and it is unlikely that the slight opposing discharge occurs at the time of the rise of the sustain pulse, and the rise of the sustain discharge between the X electrode and the Y electrode is delayed. In other words, in the discharge cell in which the address electrode is clamped to 0 V, the sustain discharge is caused to rise earlier than in the discharge cell in which the address electrode is caused to have a high impedance and the peak of the discharge current is caused to occur tens to hundreds of nanoseconds earlier. Consequently, the timing of the discharge peak differs between the address electrode of the first group connected to the odd-numbered drive IC and the address electrode of the second group connected to the even-numbered drive IC, the peak current is reduced due to the dispersion effect, the voltage drop is suppressed, and an effect that streaking is reduced can be obtained.

In the even-numbered subframe, the address electrode D1-A of the first group is caused to have a high impedance and 0 V is applied to the address electrode D2-A of the second group and therefore, in contrast to the odd-numbered subframe, the rise of the sustain discharge in the cell of the address electrode of the first group connected to the odd-numbered drive IC is delayed from the rise of the sustain discharge in the cell of the address electrode of the second group connected to the even-numbered drive IC, and the discharge is dispersed and the peak current is reduced.

As described above, the group in which 0 V is applied to the address electrode and the group in which the address electrode is caused to have a high impedance are switched between the odd-numbered and even-numbered subframes. Because of the difference in discharge intensity etc. due to voltage drop, the luminance and the chromaticity differ more or less between the discharge cell in which the timing of the sustain discharge is earlier and the discharge cell in which the timing is delayed, and therefore, if the output state for the address electrode of each group is fixed, the display quality is degraded because of the unevenness of luminance/chromaticity, however, as in the present embodiment, if the output states are switched for each subframe, the luminance/chromaticity are averaged and the unevenness becomes less conspicuous.

The dispersion effect of the sustain discharge in the first embodiment is less significant than that in the second embodiment to be described later, however, the drive waveforms in the first embodiment can be realized without modifying the conventional circuit configuration. Further, during the sustain discharge period in each subframe, what is done is only that 0 V is applied to the address electrode of the one of the groups and the address electrode of the other group is caused to have a high impedance, and therefore, there is no increase in power consumption.

In the first embodiment, when the output is caused to have a high impedance, the drive IC that causes all the outputs to have a high impedance simultaneously is used to cause the output to have a high impedance, and the division of the address electrodes into the two groups is made for each drive IC, however, as described above, it is also possible to use one capable of arbitrarily causing each output to have a high impedance and in such a case, the division of the address electrodes into the two groups can be made arbitrarily. Consequently, it is also possible to set the ratio between the numbers of address electrodes belonging to the two groups to one other than 1:1 so that the disperse of the sustain discharge is optimized.

In the first embodiment, division is made so that the odd-numbered driver ICs belong to the first group and the even-numbered driver ICs belong to the second group, however, other division methods, such as one into the right side and the left side, are also acceptable.

In the first embodiment, in order to reduce the unevenness of the luminance/chromaticity, the states of the address electrode of each group are switched for each subframe, however, this is not limited and there can be various modification examples. For example, it is also possible to switch for each display frame. Further, it is also possible to switch for each sustain pulse.

Figure 5:
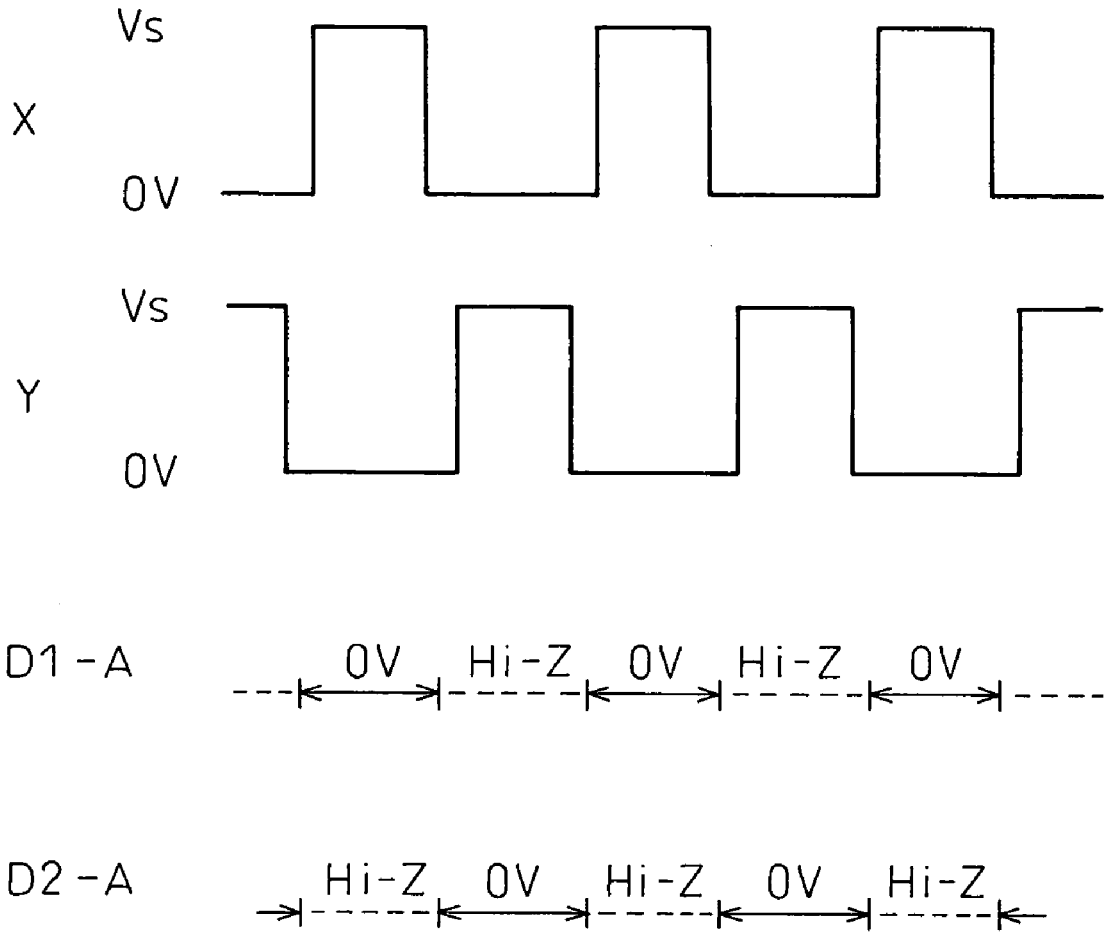
FIG. 5 is a diagram showing a modification example of the drive waveforms in the first embodiment.

FIG. 5 is a diagram showing the drive waveforms when the states of the address electrode of each group are switched for each sustain pulse. As shown schematically, the states of the address electrode of each group are switched between the state in which 0 V is applied and the high impedance state for each sustain pulse. Further, it is also possible to switch for each group of several sustain pulses. In either case, the same effect as that in the first embodiment can be obtained.

Figure 6:
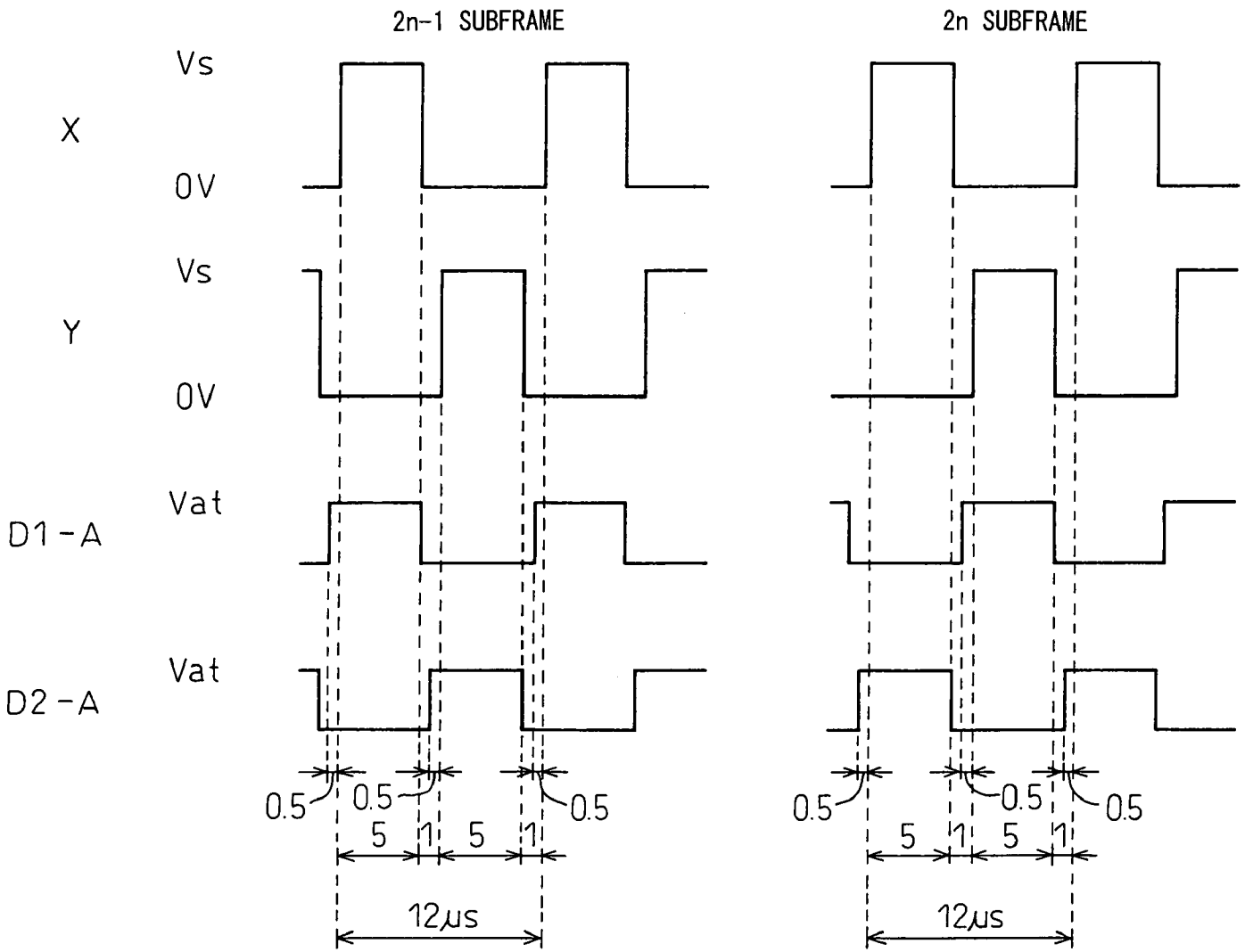
FIG. 6 is a diagram showing drive waveforms of a PDP device in a second embodiment of the present invention.

FIG. 6 is a diagram showing the drive waveforms during the sustain discharge period of a PDP device in a second embodiment of the present invention. The PDP device in the second embodiment has the same configuration as that in the first embodiment except for the drive waveforms during the sustain discharge period and as in the first embodiment, division is made so that the odd-numbered drive ICs belong to the first group and the even-numbered drive ICs belong to the second group. However, it is not necessary for the driver IC constituting the address driver to have the function of causing the output to have a high impedance. Further, in the PDP device in the second embodiment, in addition to the voltage Vaw to be applied to the address electrode during the reset period, the voltage Va to be applied during the address period, and 0 V, a voltage Vat (for example, 30 V) needs to be applied. Because of this, it is necessary for the driver IC to be capable of selectively outputting these four kinds of voltage. The inner circuit of the driver IC has a configuration in which a voltage supplied from the outside is connected to the output, and therefore, the configuration is made so that, for example, a switch circuit for switching voltages to be supplied to each driver IC is provided inside the address driver 2, and the voltages to be supplied to each driver IC are switched so that the voltage Vaw is supplied during the reset period, the voltage Va, during the address period, and the voltage Vat, during the sustain discharge period, and 0 V is supplied at all times.

As shown in FIG. 6, with the drive waveforms, the period of the sustain pulse is 12 μs, the width of the sustain pulse is 5 μs, and the intervals of 1 μs are provided, as in the first embodiment. In the odd-numbered (2n−1) subframes, the first preceding sustain pulse, which rises to the voltage Vat 0.5 μs earlier than the rise of the sustain pulse to be applied to the X electrode and which falls to 0 V at the same time as the fall of the sustain pulse to be applied to the X electrode, is applied to the address electrode of the first group, and the second preceding sustain pulse, which rises to the voltage Vat 0.5 μs earlier than the rise of the sustain pulse to be applied to the Y electrode and which falls to 0 V at the same time as the fall of the sustain pulse to be applied to the Y electrode, is applied to the address electrode of the second group.

If the first preceding sustain pulse is applied to the address electrode immediately before the application of the sustain pulse to the X electrode, a slight trigger discharge occurs between the address electrode of the first group and the Y electrode. Due to this trigger discharge, in the cell formed by the address electrode of the first group, the sustain discharge between the X electrode and the Y electrode is caused to rise earlier and the discharge peak is also caused to occur earlier. At this time, 0 V is applied to the address electrode of the first group, and therefore, no trigger discharge occurs and the rise of the sustain discharge between the X electrode and the Y electrode and the discharge peak are delayed from those in the cell in which the trigger discharge has occurred. For example, the discharge peak is caused to occur hundreds of nanoseconds to 1 μs earlier in the cell in which the trigger discharge has occurred than in the cell in which the trigger discharge has not occurred. In this manner, the sustain discharge is dispersed in the cell of the address electrode of the first group and in the cell of the address electrode of the second group, and the influence of the peak current/voltage drop is lessened and streaking is reduced. Similarly, if the second preceding sustain pulse is applied to the address electrode of the second group immediately before the application of the sustain pulse to the Y electrode, a slight trigger discharge occurs between the address electrode of the second group and the Y electrode. However, because of the state in which 0 V is applied to the address electrode of the first group, no trigger discharge will occur. Due to this, the sustain discharge is dispersed in the cells formed by the address electrodes of the first group and the second group, respectively, and the influence of the peak current/voltage drop is lessened and streaking is reduced.

In the even-numbered (2n) subframes, the second preceding sustain pulse, which rises 0.5 μs earlier than the rise of the sustain pulse to be applied to the Y electrode and falls simultaneously with the fall of the sustain pulse to be applied to the X electrode, is applied to the address electrode of the first group, and the first preceding sustain pulse, which rises to the voltage Vat 0.5 μs earlier than the rise of the sustain pulse to be applied to the X electrode and falls to 0 V simultaneously with the fall of the sustain pulse to be applied to the X electrode, is applied to the address electrode of the second group. In this case also, in the cell in which the first or second preceding sustain pulse is applied to the address electrode, the trigger discharge occurs and the sustain discharge is caused to occur earlier, however, in the cell in which 0 V is applied to the address electrode, no trigger discharge will occur and the sustain discharge is caused to occur delayingly and therefore the sustain discharge is dispersed, and the influence of the peak current/voltage drop is lessened and streaking is reduced.

In this manner, in the odd-numbered and even-numbered subframes, the timings at which to apply the voltage Vat to the address electrodes of the first and second groups are switched so that the application of the sustain pulse to the X electrode is substantially synchronized with the application of the sustain pulse to the Y electrode. Because of the difference in discharge intensity etc, due to voltage drop, the luminance and the chromaticity differ more or less between the discharge cell in which the timing of the sustain discharge is earlier and the discharge cell in which the timing is delayed, and therefore, if the preceding sustain discharge pulse to be applied to the address electrode of each group is fixed, the display quality is degraded because of the unevenness of luminance/chromaticity, however, as in the present embodiment, if the output states are switched for each subframe, the luminance/chromaticity are averaged and the unevenness becomes less conspicuous.

In the second embodiment, the address electrode of the first group is at 0 V when the sustain pulse is applied to the Y electrode and when the application of the sustain pulse to the Y electrode is terminated, positive wall charges are accumulated on the address electrode of the first group. Due to this, if the first preceding sustain pulse is applied to the address electrode of the first group before the application of the sustain pulse to the X electrode, the voltage due to the positive wall charges accumulated on the address electrode of the first group is added and the trigger discharge occurs between the address electrode and the Y electrode. At this time, negative wall charges are accumulated on the Y electrode and, therefore, the voltage due to them is added, however, the positive wall charges are accumulated on the X electrode and the voltage due to them reduces the voltage between the electrodes and, therefore, it is unlikely that the trigger discharge occurs between the address electrode and the X electrode. In either case, in the second embodiment, the address electrode of the first group is at 0 V when the sustain pulse is applied to the Y electrode and a sufficient number of wall charges are accumulated and, therefore, it is possible to cause the trigger discharge to occur without the need to raise the voltage Vat of the first preceding sustain pulse so much. This also applies to the second preceding sustain pulse.

Further, the second embodiment is characterized in that the charge/discharge loss of the line capacitance is small because the fall of the first and second preceding sustain pulses is synchronized with the fall of the sustain pulse.

In the second embodiment, division is made so that the address electrodes connected to the odd-numbered drive ICs belong to the first group and the address electrodes connected to the even-numbered drive ICs belong to the second group, however, division of the address electrodes into two groups can be made arbitrarily. If, however, the number of address electrodes neighboring the boundary between the two groups is increased, when, for example, division is made on the entire surface so that the odd-numbered address electrodes belong to the first group and the even-numbered address electrodes belong to the second group, there arises a problem that the charge/discharge loss, due to the line capacitance when the address electrode is driven during the sustain pulse period, increases.

Further, in the second embodiment, division is made so that the odd-numbered driver ICs belong to the first group and the even-numbered driver ICs belong to the second group, however, there are other division methods, such as a method in which division is made vertically into a right side group and a left side group.

In the second embodiment, in order to suppress the unevenness of the luminance/chromaticity, the pulses to be applied to the address electrode of each group are switched for each subframe, however, this is not limited and there can be various modification examples and, for example, it is also possible to switch for each display frame.

Furthermore, in the second embodiment, the address electrodes are divided into the two groups and the voltage Vat of the first and second preceding sustain pulses and the timing difference from the rise of the sustain pulse are fixed, however, it is also possible to increase the number of groups and produce various kinds of the voltage Vat of the first and second preceding sustain pulses and the timing differences from the rise of the sustain pulse.

Figure 7:
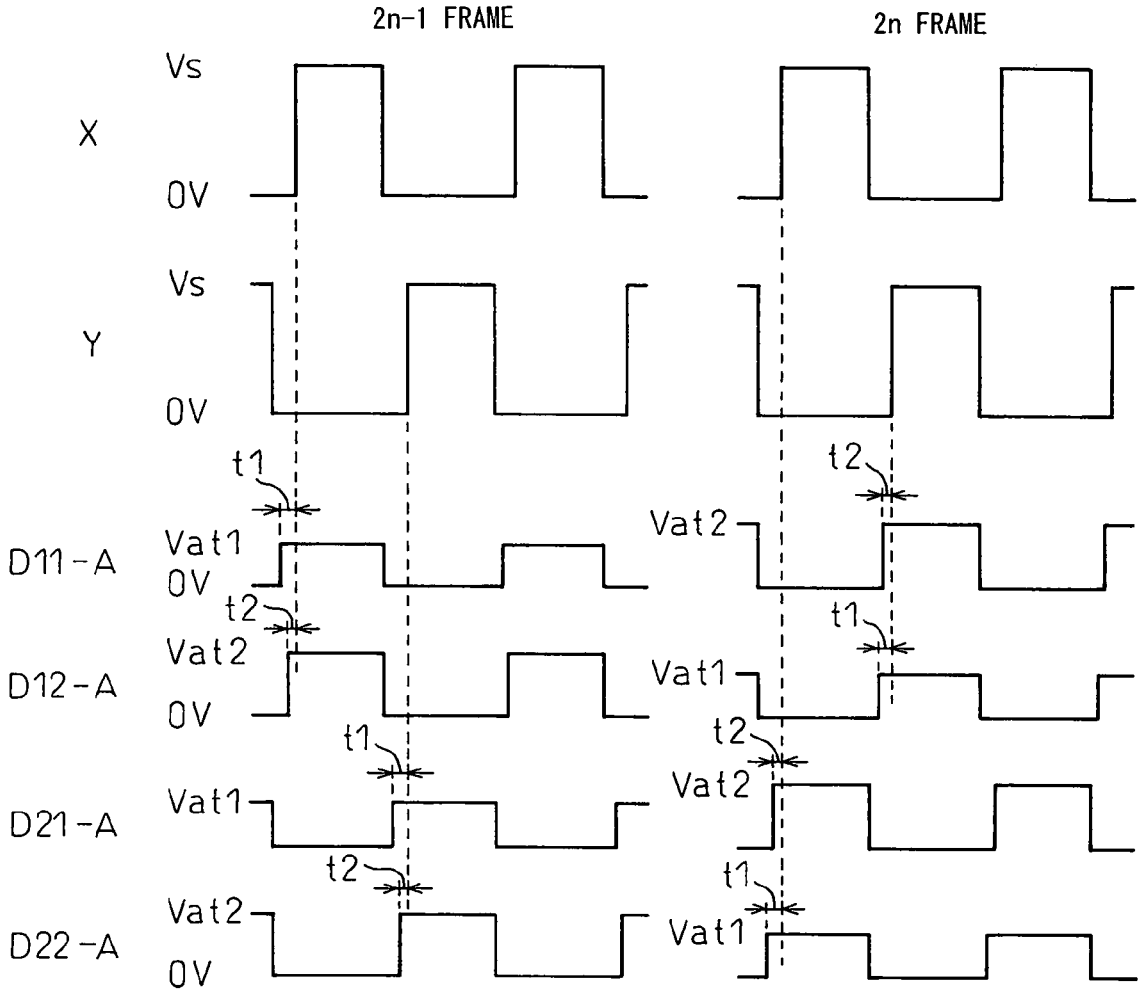
FIG. 7 is a diagram showing a modification example of the drive waveforms in the second embodiment.

FIG. 7 shows drive waveforms of such a modification example. In this modification example, the drive ICs of the first group in the second embodiment are further divided into two groups D11 and D12 and the drive ICs of the second group are further divided into two groups D21 and D22. In correspondence with this, the address electrodes are divided into four groups D11-A, D12-A, D21-A, and D22-A. As shown in FIG. 7, in the odd-numbered subframe, a pulse having a voltage Vat1, which rises t1 earlier than the sustain pulse of the X electrode, is applied to the address electrode D11-A of the first group (the fall synchronizes with that of the sustain pulse. This also applies to other cases), a pulse having a voltage Vat2, which rises t2 earlier than the sustain pulse of the X electrode, is applied to the address electrode D12-A of the second group, a pulse having a voltage Vat1, which rises t1 earlier than the sustain pulse of the Y electrode, is applied to the address electrode D21-A of the third group, and a pulse having a voltage Vat2, which rises t2 earlier than the sustain pulse of the Y electrode, is applied to the address electrode D22-A of the fourth group. Further, in the even-numbered subframe, a pulse having a voltage Vat2, which rises t2 earlier than the sustain pulse of the Y electrode, is applied to the address electrode D11-A of the first group (the fall synchronizes with that of the sustain pulse. This also applies to other cases), a pulse having a voltage Vat1, which rises t1 earlier than the sustain pulse of the Y electrode, is applied to the address electrode D12-A of the second group, a pulse having a voltage Vat2, which rises t2 earlier than the sustain pulse of the X electrode, is applied to the address electrode D21-A of the third group, and a pulse having a voltage Vat1, which rises t1 earlier than the sustain pulse of the X electrode, is applied to the address electrode D22-A of the fourth group. Due to this, the rise of the sustain discharge is further dispersed and the peak current can be further reduced.

Further, it is also possible to randomly vary the voltage Vat of the first and second preceding sustain pulses and the timing difference, in rise-time, from that of the sustain pulse in the drive waveforms in the second embodiment in FIG. 6 and in the drive waveforms in FIG. 7. Furthermore, it is also possible to randomly vary the voltage to be supplied to each drive IC during the sustain discharge period independently, and to randomly vary the timing difference between the preceding sustain pulse that each drive IC outputs and the sustain pulse. In this case, the rise of the sustain discharge is widely dispersed and the sustain discharge is caused to rise randomly, and therefore, the difference in luminance/chromaticity is averaged over the entire screen and becomes less conspicuous.

In the embodiments explained above, the voltage applied to the X, Y, and address electrodes is a positive voltage with reference to 0 V, however, a configuration in which a negative voltage is applied is also possible. In this case, when 0 V is applied in the embodiments, it follows that a negative voltage is applied.

FIELD OF INDUSTRIAL APPLICATION

According to the present invention, it is possible to substantially reduce the peak current without the need to modify the currently existing drive circuit and, therefore, a PDP device (AC-type gas-discharge display device) with high image quality can be realized at a low cost. Due to this, it is made possible to use the PDP device in many applications.

What is claimed:

1. An AC-type gas-discharge display device, comprising:

an AC-type gas-discharge panel having a plurality of first and second electrodes extending in a first direction and arranged by turns substantially in parallel and a plurality of third electrodes extending in a direction perpendicular to the first direction and arranged so as to intersect the first and second electrodes and in which a cell is formed at the intersection of a combination of the first and second electrodes and the third electrode, wherein:

during an address period, an address discharge is caused to occur between the second electrode and the third electrode to select a cell to be lit;

during a sustain discharge period, sustain pulses of opposite polarities are applied alternately between the plurality of the first electrodes and the plurality of the second electrodes to cause a discharge to occur for the display of the cell selected during the address period;

the plurality of the third electrodes are divided into first and second groups; and during the sustain discharge period, a fixed voltage is applied to the third electrode in one of the first and second groups and the third electrode in the other of the first and second groups is caused to have a high impedance.

2. The AC-type gas-discharge display device as set forth in claim 1, wherein:

the plurality of the third electrodes are driven by a plurality of driver ICs capable of switching between a state in which a fixed voltage is applied and a high impedance state for each output; and the plurality of the third electrodes are divided into first and second groups for each driver IC.

3. The AC-type gas-discharge display device as set forth in claim 1, wherein the plurality of the third electrodes are driven by a driver IC capable of switching between a state in which a fixed voltage is applied and a high impedance state for each output.

4. The AC-type gas-discharge display device as set forth in claim 1, wherein switching is made for each subframe or frame between the state in which a fixed voltage is applied to the third electrode of the first group and the third electrode of the second group is at a high impedance and another state in which the third electrode of the first group is at a high impedance and the predetermined voltage is applied to the third electrode of the second group.

5. The AC-type gas-discharge display device as set forth in claim 1, wherein switching is made for each sustain pulse between the state in which a fixed voltage is applied to the third electrode of the first group and the third electrode of the second group is at a high impedance and another state in which the third electrode of the first group is at a high impedance and the predetermined voltage is applied to the third electrode of the second group.

6. An AC-type gas-discharge display device, comprising:

an AC-type gas-discharge panel having a plurality of first and second electrodes extending in a first direction and arranged by turns substantially in parallel and a plurality of third electrodes extending in a direction perpendicular to the first direction and arranged so as to intersect the first and second electrodes and in which a cell is formed at the intersection of a combination of the first and second electrodes and the third electrode, wherein:

during an address period, an address discharge is caused to occur between the second electrode and the third electrode to select a cell to be lit;

during a sustain discharge period, sustain pulses of opposite polarities are applied alternately between the plurality of the first electrodes and the plurality of the second electrodes to cause a discharge to occur for the display of the cell selected during the address period;

the plurality of the third electrodes are divided into first and second groups; and during the sustain discharge period, a first preceding sustain pulse, which rises before the rise of the sustain pulse to be applied to the first electrode and falls substantially in synchronization with the fall of the sustain pulse to be applied to the first electrode, is applied to the third electrode of one of the first and second groups, and a second preceding sustain pulse, which rises before the rise of the sustain pulse to be applied to the second electrode and falls substantially in synchronization with the fall of the sustain pulse to be applied to the second electrode, is applied to the third electrode of the other of the first and second groups.

7. The AC-type gas-discharge display device as set forth in claim 6, wherein:

the third electrodes of the one of the groups, that is, the first group, are further divided into a plurality of first subgroups;

the third electrodes of the other of the groups, that is, the second group, are further divided into a plurality of second subgroups;

first preceding sustain pulses having different voltages or timings from the rise of the sustain pulse to be applied to the first electrode are applied to the plurality of the first subgroups, respectively; and second preceding sustain pulses having different voltages or timings from the rise of the sustain pulse to be applied to the second electrode are applied to the plurality of the second subgroups, respectively.

8. The AC-type gas-discharge display device as set forth in claim 7, wherein:

the plurality of the third electrodes are driven by a plurality of driver ICs; and the plurality of the third electrodes are divided into first and second groups for each driver IC.

9. The AC-type gas-discharge display device as set forth in claim 6, wherein:

the plurality of the third electrodes are driven by a plurality of driver ICs; and the plurality of the third electrodes are divided into first and second groups for each driver IC.

10. The AC-type gas-discharge display device as set forth in claim 6, wherein switching is made for each subframe or frame between the state in which the first preceding sustain pulse is applied to the third electrode of the first group and the second preceding sustain pulse is applied to the third electrode of the second group and another state in which the second preceding maintain pulse is applied to the third electrode of the first group and the first preceding maintain pulse is applied to the third electrode of the second group.

11. An AC-type gas-discharge display device, comprising an AC-type gas-discharge panel having a plurality of first and second electrodes extending in a first direction and arranged by turns substantially in parallel and a plurality of third electrodes extending in a direction perpendicular to the first direction and arranged so as to intersect the first and second electrodes and in which a cell is formed at the intersection of a combination of the first and second electrodes and the third electrode, wherein:

during an address period, an address discharge is caused to occur between the second electrode and the third electrode to select a cell to be lit;

during a sustain discharge period, sustain pulses of opposite polarities are applied alternately between the plurality of the first electrodes and the plurality of the second electrodes to cause a discharge to occur for the display of the cell selected during the address period;

the plurality of the third electrodes are divided into a plurality of groups; and during the sustain discharge period, a voltage pulse is applied to the third electrode before and after the sustain discharge caused to occur by the sustain pulse to be applied between the first electrode and the second electrode, and the voltage value of the voltage pulse or the timing from the rise of the sustain pulse, or both, vary randomly.

* * * * *

UNITED STATES PATENT AND TRADEMARK OFFICE

CERTIFICATE OF CORRECTION

PATENT NO. : 7,639,212 B2
APPLICATION NO. : 11/596067
DATED : December 29, 2009
INVENTOR(S) : Akira Otsuka et al.

It is certified that error appears in the above-identified patent and that said Letters Patent is hereby corrected as shown below:

Title page, Column 1 (Inventors), Line 2, change "Akhiro" to --Akihiro--.

Column 1, Line 11, change "content" to --contents--.

Signed and Sealed this

Twenty-third Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,639,212 B2
APPLICATION NO. : 11/596067
DATED : December 29, 2009
INVENTOR(S) : Otsuka et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 646 days.

Signed and Sealed this

Ninth Day of November, 2010

David J. Kappos

David J. Kappos
*Director of the United States Patent and Trademark Office*